US006484998B1

(12) United States Patent
Schäffer

(10) Patent No.: US 6,484,998 B1
(45) Date of Patent: Nov. 26, 2002

(54) ELECTROMAGNET AND HYDRAULIC VALVE COMPRISING SUCH AN ELECTROMAGNET

(75) Inventor: Rudolf Schäffer, Marktheidenfeld (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/913,399

(22) PCT Filed: Feb. 15, 2000

(86) PCT No.: PCT/EP00/01217

§ 371 (c)(1),
(2), (4) Date: Aug. 10, 2001

(87) PCT Pub. No.: WO00/51145

PCT Pub. Date: Aug. 31, 2000

(30) Foreign Application Priority Data

Feb. 22, 1999 (DE) ..... 199 07 536
Jan. 26, 2000 (DE) ..... 100 03 427

(51) Int. Cl.[7] ..... H01F 7/16

(52) U.S. Cl. ..... 251/65; 251/129.09; 251/129.15; 251/129.2; 335/276; 335/279

(58) Field of Search ..... 251/129.09, 129.15, 251/129.2, 65; 335/279, 276, 275; 137/625.65

(56) References Cited

U.S. PATENT DOCUMENTS 3,791,408 A * 2/1974 Saitou et al. ..... 251/129.15
3,858,135 A 12/1974 Gray
4,540,154 A * 9/1985 Kolchinsky et al. ... 251/129.15
4,638,974 A * 1/1987 Zeuner et al. ..... 251/129.15
4,725,040 A * 2/1988 Fornuto et al. ..... 251/129.15
5,156,184 A * 10/1992 Kolchinsky ..... 251/129.2
5,544,857 A * 8/1996 Torrence ..... 251/129.15

FOREIGN PATENT DOCUMENTS

DE 29704583 4/1997
WO 9719457 5/1997

* cited by examiner

*Primary Examiner*—Henry C. Yuen
*Assistant Examiner*—John Bastianelli
(74) *Attorney, Agent, or Firm*—Martin A. Farber

(57) ABSTRACT

A solenoid valve (50) has a valve housing (51) with a valve slide (53) in which two magnets, with one pole (1) each, are inserted. The poles (1) each have a coil core (8, 9) which extends along a longitudinal axis (10) and in which in each case one armature tappet (17), which activates one end of the valve slide (53) with an activation end (27), is provided. Arranged on each armature tappet (17) is a magnet armature (23) which has two armature side faces (24, 25) which extend obliquely with respect to the longitudinal axis (10). The coil core (8, 9) has two core side faces (12, 19) which extend parallel to one armature side face (24, 25) in each case.

15 Claims, 8 Drawing Sheets

ELECTROMAGNET AND HYDRAULIC VALVE COMPRISING SUCH AN ELECTROMAGNET

FIELD AND BACKGROUND OF THE INVENTION

The invention relates to a pole for a magnet which can be used in particular in a hydraulic solenoid valve. The invention also relates to a magnet and to a hydraulic solenoid valve.

The poles known from the prior art have the disadvantage of a high degree of inertia. For this reason, in particular hydraulic solenoid valves are complicated to activate. Furthermore, the poles known in the prior art have a high degree of friction. Furthermore, when mounting it is necessary to take care that there are no air bubbles in the interior of the armature space because the poles known from the prior art have a modified dynamic depending on the proportion of air in the armature space.

Furthermore, the poles known from the prior art have the disadvantage of marked wear.

SUMMARY OF THE INVENTION

The object of the invention is therefore to provide a pole which has a low degree of wear and is highly responsive. The pole which is to be provided is to be insensitive to proportions of air in the armature space and to be of simple design. It is also the object of the invention to provide a magnet which is improved in this respect and a hydraulic solenoid valve which is improved in this respect.

This object is achieved by means of the subject matter of the independent claims. Advantageous refinements emerge from the respective subclaims.

With such a configuration, the magnet armature moves transversely with respect to the longitudinal axis when current flows through the electrical coil. Because of the particular interrupted construction of the coil core in the region of the magnet armature, the magnetic field lines emerge, in fact, from a first coil core section, into the magnet armature and out again and then into a second coil core section. Owing to the armature side faces which are of "oblique" construction with respect to the longitudinal axis, a force component which extends transversely with respect to the longitudinal axis and acts on the magnet armature is produced, said force component displacing the magnet armature, and thus the armature tappet connected to the magnet armature, transversely with respect to the longitudinal axis. According to the invention, this transverse movement is used to activate, in particular, a valve slide of a hydraulic solenoid valve.

According to the invention, the magnet armature can also have two armature side faces which are cut from the longitudinal axis with an angle other than 90°, the two armature side faces being constructed in a preferred embodiment so as to be symmetrical with respect to a plane extending perpendicular to the longitudinal axis. In particular with this construction of the two armature side faces, the components of the force acting on the magnet armature which are generated as a result of the magnetic flux and extend in the direction of the longitudinal axis cancel each other out so that there is no additional loading in the longitudinal direction of the armature tappet. This increases the operational reliability of the pole according to the invention. In addition, a transverse force component whose absolute value is doubled in comparison with a single, obliquely arranged armature side face acts on the magnet armature. This improves the efficiency of the pole according to the invention.

According to the invention, the coil core can have at least one or even two core side faces which are cut from the longitudinal axis at an angle other than 90°, it being possible for the two core side faces to be constructed so as to be symmetrical with respect to a plane running perpendicular to the longitudinal axis. Constructing the coil core in such a way improves the guidance of the magnetic field lines in the interior of the pole according to the invention, which increases its efficiency. It is particularly advantageous here if in each case one armature side face extends essentially parallel to a core side face lying opposite it because the course of the magnetic field lines in the pole according to the invention can then be configured particularly satisfactorily. Furthermore, the behavior of a pole which is configured in this way can be modeled and predicted particularly satisfactorily so that in particular also linear activation processes and precise adjustments are made possible.

In the configurations of the pole according to the invention described above, the designation "essentially parallel" with respect to the position of armature side faces and core side faces means that in each case one core side face extends parallel to an armature side face in at least one activation state of the magnet armature. It is not excluded here that when the magnet armature is displaced one armature side face assumes in each case a position with respect to a core side face in which they no longer extend parallel to one another. Such states can arise in particular when there are large displacements of an armature tappet which is mounted on only one side.

Furthermore, it is possible to provide in the interrupted region of the coil core a connecting region made of antimagnetic material which connects sections of the coil core to one another. This results in a compact and stable design of the coil core which is also sealed to prevent hydraulic fluid escaping.

In the interrupted region of the coil core, it is also possible to provide a connecting region which has magnetizable material. As a result, an additional air gap can be provided which, before the actual switching of the magnet by an electrical coil in the region of the magnet armature, can be brought to saturation by an electrical coil in the region of the magnet armature. This results in the armature being additionally acted on in its direction of movement even before the magnet armature according to the invention actually switches. In such a state, the magnet armature according to the invention is kept in a starting position from which it can be moved into its switched position by increasing the current. Here, the force generated by the additional air gap does not increase further because said air gap is preferably saturated. However, the force generated by a working air gap between the pole and the magnet armature increases with the increase in the magnetic field density in the region of the pole. As soon as the force in the working air gap is greater than the force in the additional air gap, the magnet armature moves in the direction of the force generated in the working air gap. The force which is generated in the additional air gap decreases with a very steep characteristic curve because the associated air gap becomes larger and because at the same time the working air gap becomes smaller. As a result, the force generated in the working air gap is available immediately, and to its full extent, for switching a magnet provided with the pole according to the invention. Furthermore, there are hardly any decelerations due to eddy currents if the main part of the magnetic field in the working air gap has already been built up by a biasing current.

The development according to the invention provides numerous advantages. For example, the current has to be increased only to a small extent to switch the magnet according to the invention. At the same time, hardly any eddy current decelerations occur during the switching, and a high switching force is available just after the start of the stroke of the magnet armature. The armature according to the invention can be used particularly advantageously in conjunction with the particular advantages of a swivel armature magnet which is obtained in such a way, namely those of a low armature mass and of negligible friction of the armature within the pole, and by preventing an increase in mass as a result of oil which is to be expelled through narrow drilled holes.

The pole according to the invention can be manufactured easily if the coil core and/or the magnet armature are each constructed as an essentially cylindrical tubular section. Here, the magnet armature is preferably constructed in such a way that it can be permanently attached to a bar-shaped armature tappet while the coil core has a through-opening which is constructed in such a way that the armature tappet does not bear against the inside of the coil core even when there are large displacements of the magnet armature.

If a first end of the armature tappet is permanently connected to a first end of the coil core, when a displacement occurs the magnet armature moves on an orbit about the mounting point of the armature tappet on the coil core. A transverse movement of the magnet armature which occurs here can then be transmitted particularly easily to, for example, a valve slide of a hydraulic solenoid valve. There is also provision here that a second end of the armature tappet projects beyond a second end of the coil core. In order to activate, for example, a valve slide, it is then sufficient to mount the coil core in a valve housing and to bring the second end of the armature tappet into contact with the valve slide.

The invention is also implemented in a magnet, in particular for a hydraulic solenoid valve, which has a pole which is configured according to the invention as described above, at least one electrical coil also being provided in the region of the coil core.

The invention is also implemented in a magnet which has two electrical coils which are preferably arranged coaxially with respect to one another. It is particularly advantageous here if use is made of a magnet pole in which a connecting region with magnetizable material is provided in the interrupted region of the coil core. With two such coils it is particularly easily possible to achieve premagnetization, which permits improved operation with a second air gap.

In contrast to the above, or in addition thereto, it may be possible to apply not only two different operating voltages but also three different operating voltages to the electrical coil or coils. Here, it is possible to switch, starting from a quiescent potential which constitutes the first operating voltage, via the second operating voltage into the third operating voltage. The second operating voltage generates here the premagnetization, while the third operating voltage constitutes the actual switching current of the magnet.

According to the invention, the magnet armature can, however, also be premagnetized by means of a permanent magnet.

In addition, the invention also relates to a hydraulic solenoid valve with at least one magnet according to the invention, the solenoid valve having a valve slide which can be activated by the armature tappet.

The swivel arm magnet according to the invention as described above is particularly advantageous because it operates with low friction and as a result has no wear, or only a small degree of wear. Furthermore, it is highly responsive because it is not necessary to overcome any static friction in order to activate it. In particular in the construction with two obliquely extending working gaps which are symmetrical with respect to one another, the particular advantage is obtained that no resulting force occurs in the axial direction of the armature tappet which is to be bent. In addition, the magnet armature can be made particularly small, which improves the actuation characteristics of the magnet according to the invention. Furthermore, the magnet according to the invention does not have any reduced oil mass so that no significant dynamic differences occur irrespective of whether there is oil or air in the armature space. Finally, the magnet according to the invention is of particularly simple design.

The invention is also embodied in the form of a pole which has a magnet armature in which the armature side faces intersect the longitudinal axis at a right angle if at the same time the coil core has, in the region of the magnet armature, at least one core side face which is intersected by the longitudinal axis at an angle other than 90°. Even with such a construction which is reversed in comparison with the configurations described above, the field lines in the air gap extend between the magnet armature and coil core in such a way that a force component which extends perpendicularly to the longitudinal axis and deflects the magnet armature is produced.

BRIEF DESCRIPTION OF THE DRAWINGS

The invention is illustrated in the drawing by means of an exemplary embodiment. In said drawing.

DETAILED DESCRIPTION OF THE PREFERRED EMBODIMENT

Figure 1:
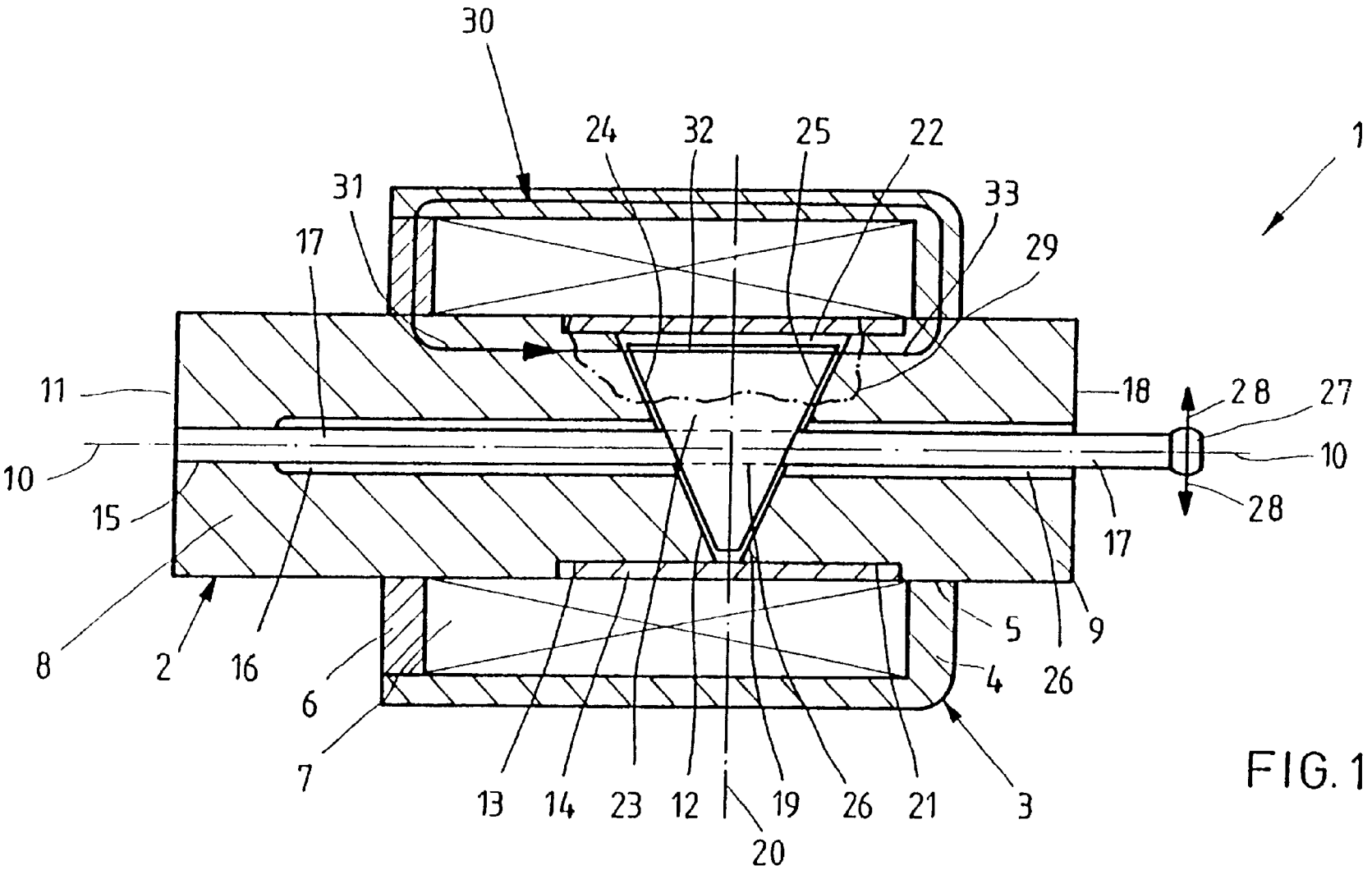
FIG. 1 shows a cross-section through a pole according to the invention.

FIG. 1 shows a cross-section through a pole 1. The pole 1 has a core 2 with an essentially cylindrical outer shape on the outside of which an electrical coil 3 is provided.

The coil 3 has an essentially pot-shaped coil housing 4 which is provided, on its base side located to the right in FIG. 1, with a core opening 5 which adjoins the outside of the core 2. On the side lying opposite the core opening 5, the coil 3 is sealed with an annular washer 6 whose inner circumference adjoins the core 2 and whose outer circumference adjoins the coil housing 4. A coil winding 7, which can be supplied with electrical energy by means of two terminals (not shown in this view), is inserted into the space formed by the outside of the core 2 and by the inner sides of the coil housing 4 and by the annular washer 6.

The core 2 is divided into a first core section 8, which is located on the left in FIG. 1, and into a second core section 9, which is located on the right in FIG. 1. The first core section 8 and the second core section 9 are manufactured from magnetizable material and have a common longitudinal axis 10.

Here, the first core section 8 has a first end face 11 which is located to the left in FIG. 1 and which is produced as a cutting plane of a plane which extends perpendicularly to the longitudinal axis 10 and comprises the first core section 8. On the end lying opposite the first end face 11, the first core section 8 has a first core side face 12 which is produced as a cutting plane of a plane which extends obliquely with respect to the longitudinal axis 10 and comprises the first core section 8. The first core section 8 is provided on its outer face located on the outside with a first pressure tube shoulder 13 to which a pressure tube 14 made of antimagnetic material is attached.

The first core section 8 is also provided in the region of the first end face 11 with a tappet receptacle hole 15 which extends in the region of the longitudinal axis 10. The tappet receptacle hole 15 extends here in the direction of the first core side face 12 to form a first tappet drilled hole section 16. Here, an essentially rod-shaped armature tappet 17 is inserted into the tappet receptacle hole 15 and secured there.

The second core section 9 has, at its end which is located to the right in FIG. 1, a second end face 18 which is produced as a cutting plane of a plane which extends perpendicularly to the longitudinal axis 10 and comprises the second core section 9. At the end of the second core section 9 lying opposite the first end face 18, a second core side face 19 is constructed which is produced as a cutting face of a plane which extends obliquely with respect to the longitudinal axis 10 and comprises the second core section 9. The second core side face 19 and the first core side face 12 are arranged symmetrically with respect to one another in a plane 20 of symmetry extending perpendicularly to the longitudinal axis 10.

In the interior of the second core section 9, a second tappet drilled hole section 26 is also formed along the longitudinal axis 10, said tappet drilled hole section 26 having a diameter which corresponds to that of the first tappet drilled hole section 16. Here, the armature tappet 17 extends through the second tappet drilled hole section 26 and emerges on the second end face 18. On the section of the armature tappet 17 which emerges from the second core section 9, said armature tappet 17 is of thickened construction to form an activation ball section 27.

On its outside, the second core section 9 is provided with a circumferential, second pressure tube shoulder 21 on which the pressure tube 14 is arranged. As a result, the second core section 9 is connected via the pressure tube 14 to the first core section 8, an armature space 22 which is essentially in the shape of a trapezium in cross-section being constructed by the first core side face 12, the second core side face 19 and the inside of the pressure tube 14.

A magnet armature 23 which is manufactured from magnetizable material is arranged in the armature space 22. The magnet armature 22 is essentially in the shape of a cylinder whose axis of symmetry extends parallel to the longitudinal axis 10. The two end faces of the magnet armature 23 extend obliquely with respect to the longitudinal axis 10, an end face being constructed as a first armature side face 24 which extends essentially parallel to the first core side face 12. The other end face of the magnet armature 23 is formed as a second armature side face 25 which extends essentially parallel to the second core side face 19. Along the longitudinal axis 10, the magnet armature 23 is provided with a magnet armature drilled hole 26 through which the armature tappet 17 extends. The magnet armature 23 is permanently mounted on the armature tappet 17 and arranged in the armature space 22 in such a way that in the quiescent state of the magnet armature 23 an air gap is formed on all sides between its outer surface and the inner surface of the armature space 22.

Owing to the arrangement of the magnet armature 23 on the armature tappet 17 mounted in the first core section 8, the activation ball section 27 of the armature tappet 17 moves in a direction of movement indicated in FIG. 1 by two movement arrows 28 when the magnet armature 23 moves in the armature space 22.

Figure 2:
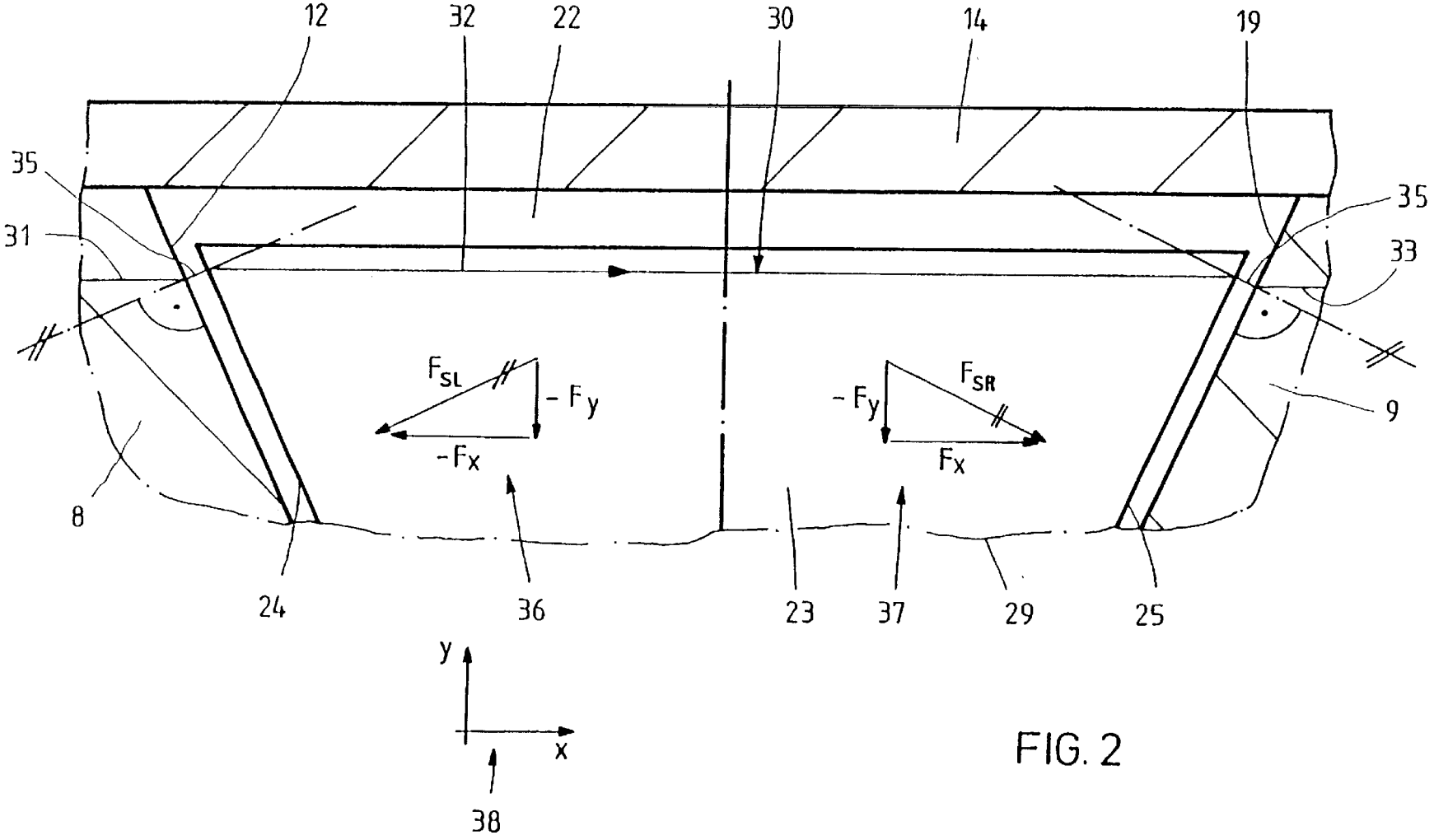
FIG. 2 shows an enlarged detail of the illustration of the pole in FIG. 1.

In order to illustrate the function of the pole 1, an enlarged detail of the illustration from FIG. 1 is used in FIG. 2, the enlarged detail in FIG. 2 being bounded by a contour line 29 which is shown in FIG. 1. In addition, for the purposes of illustration a magnetic field line 30 which is shown by way of example in FIG. 1 is used, said field line 30 representing the magnetic flux through the pole 1 when the coil winding 7 is supplied with electrical energy. As is shown in FIG. 2, the magnetic field line 30 has a first field line section 31 which extends within the first core section 8, to be precise essentially parallel to the longitudinal axis 10. Furthermore, the field line 30 has a second field line section 32 which extends within the magnet armature 23, to be precise also essentially parallel to the longitudinal axis 10. Finally, the magnetic field line 30 has a third field line section 33 which extends essentially parallel to the longitudinal axis 10 within the second core section 9.

In the air gaps between the magnet armature 23 and the first core side face 12 or the second core side face 19, the field line 30 has a first transitional field line section 34 or a second transitional field line section 35. The first transitional field line section 34 extends here perpendicularly to the first core side face 12 and to the first armature side face 24, while the second transitional field line section 35 extends perpendicularly to the core side face 19 and to the second armature side face 25.

Forces $F_{SL}$ which extend parallel to the first transitional field line section 34 act in the air gap between the first core section 8 and the magnet armature 23 as a result of the magnetic flux through the core 2. In addition, forces $F_{SR}$ which extend parallel to the second transitional field line section 35 act between the magnet armature 23 and the second core side face. These forces $F_{SL}$ and $F_{SR}$ can be decomposed into components which extend parallel to the longitudinal axis 10 or perpendicular to the longitudinal axis 10. Here, there is a left force triangle 36 and a right force triangle 37 which are illustrated by way of example in FIG. 2 together with a coordinate system 38. The two forces $F_{SL}$ and $F_{SR}$ are identical in terms of absolute value. However, they are different in terms of their respective direction. As can be seen in FIG. 2, their two components $-F_x$ and $F_x$ which extend in the x direction cancel one another out so that the magnet armature 23 is not acted upon by any force in the x direction. The two remaining components $-F_y$ of the two forces $F_{SL}$ and $F_{SR}$ add together to form an overall force $-2F_y$ which displaces the magnet armature 23 in a direction opposite to the y direction.

As can be seen particularly well in FIG. 2, there is a relationship between the angle which is enclosed between the first core side face 12, the second core side face 19, the first armature side face 24 or the second armature side face 25 and the longitudinal axis 10 on the one hand and the absolute values of the force components of the two forces $F_{SL}$ and $F_{SR}$ acting in the direction of the y axis, on the other. By varying the above-mentioned angles and the size of the air gap in the armature space 22, it is possible to react to different requirements in terms of the required deflection of the activation ball section 27 at the armature tappet 17. The smaller the cutting angle between the longitudinal axis 10 and the first core side face 12, the second core side face 19, the first armature side face 24 or the second armature side face 25, the larger the proportion of the respective force components in the direction of the y axis.

Figure 3:
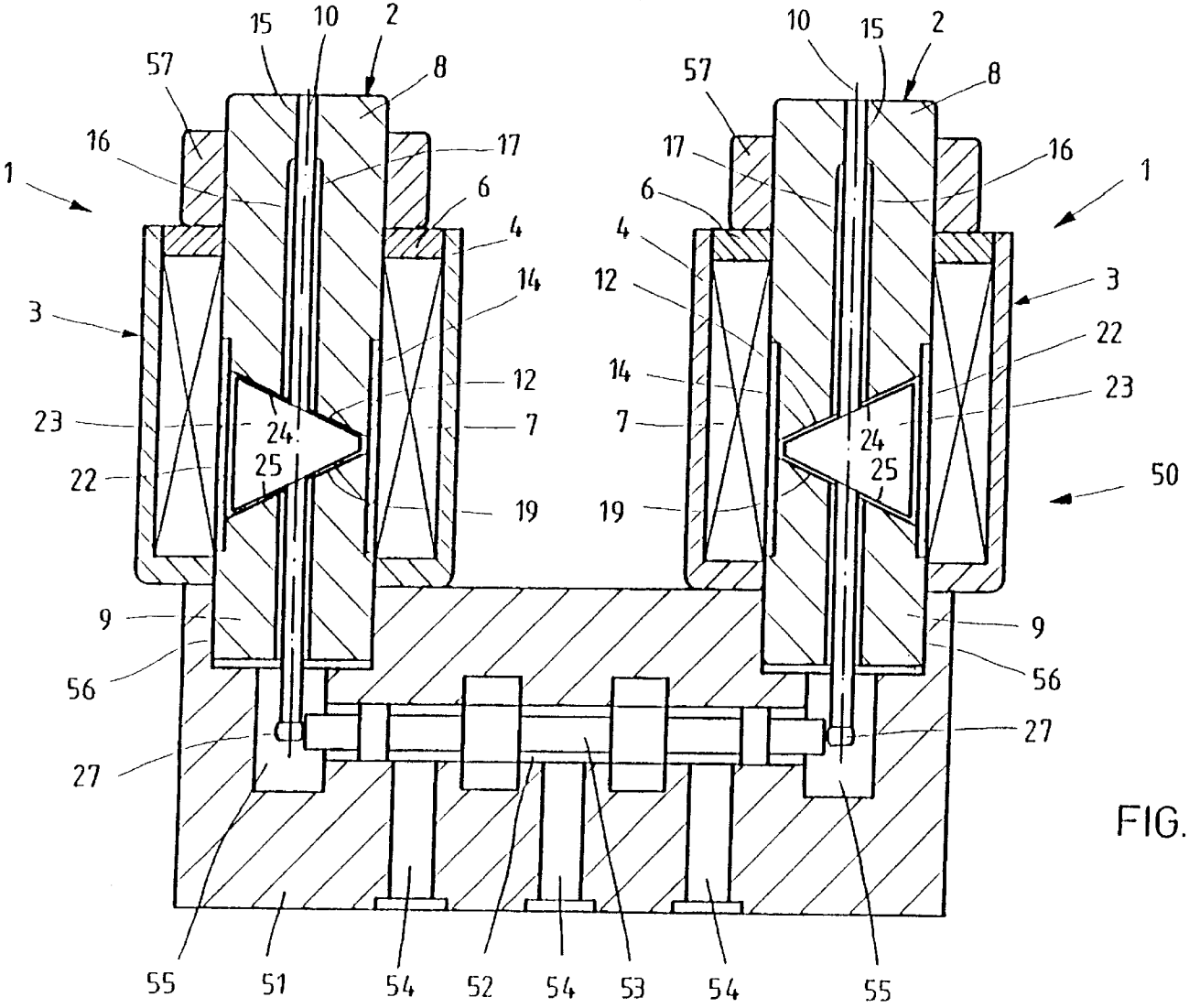
FIG. 3 shows a hydraulic proportional directional control valve according to the invention.

FIG. 3 shows a solenoid valve 50 according to the invention in cross-section.

The solenoid valve 50 has a valve housing 51 in which a valve piston drilled hole 52 is provided with a valve piston 53 inserted therein. Hydraulic ducts 54 lead out of the valve piston drilled hole 52 to the outside of the valve housing 51.

A pole drilled hole 55 which extends essentially perpendicularly to the valve piston drilled hole 52 is constructed in the region of each end of the valve piston 53. In the outlet region of the pole drilled holes 55, they are expanded to form pole receptacle openings 56 into which in each case one pole 1 from FIG. 1 is inserted. Here, in each case the second core section 9 is pushed into the pole receptacle opening until the underside of the coil housing 4 bears against the valve housing 4. In this state, in each case the activation ball sections 27 of the armature tappets 17 touch the ends of the valve piston 53. A securing ring 57 which is in each case fitted onto the first core section 8 secures the coil 3 on the core 2 against slipping down.

During operation, the solenoid valve 50 behaves as follows. If the valve piston 53 is to be pushed to the left in the illustration shown in FIG. 3, the coil 7 of the pole 1 which is located to the right in FIG. 3 is supplied with electrical energy. The magnet armature 23 of the pole 1 which is located to the right in FIG. 3 then moves to the left and thus pushes the tappet 17 and the activation ball section 27 to the left. Here, the activation ball section 27 of the pole 1 which is located to the left in FIG. 3 is also pushed to the left until, owing to the bending of the armature tappet 17, it exerts an opposing force on the valve piston 53 which has such a magnitude that a force equilibrium prevails. If this is desired, for example in the course of an adjustment, the pole 1 which is located to the left in FIG. 3 can also simultaneously be activated by supplying its coil winding 7 with electrical energy.

After the interruption of the supply of electrical energy to the coil windings 7, the armature tappets 17 and the valve piston 53 return to the home position shown in FIG. 3.

Figure 4:
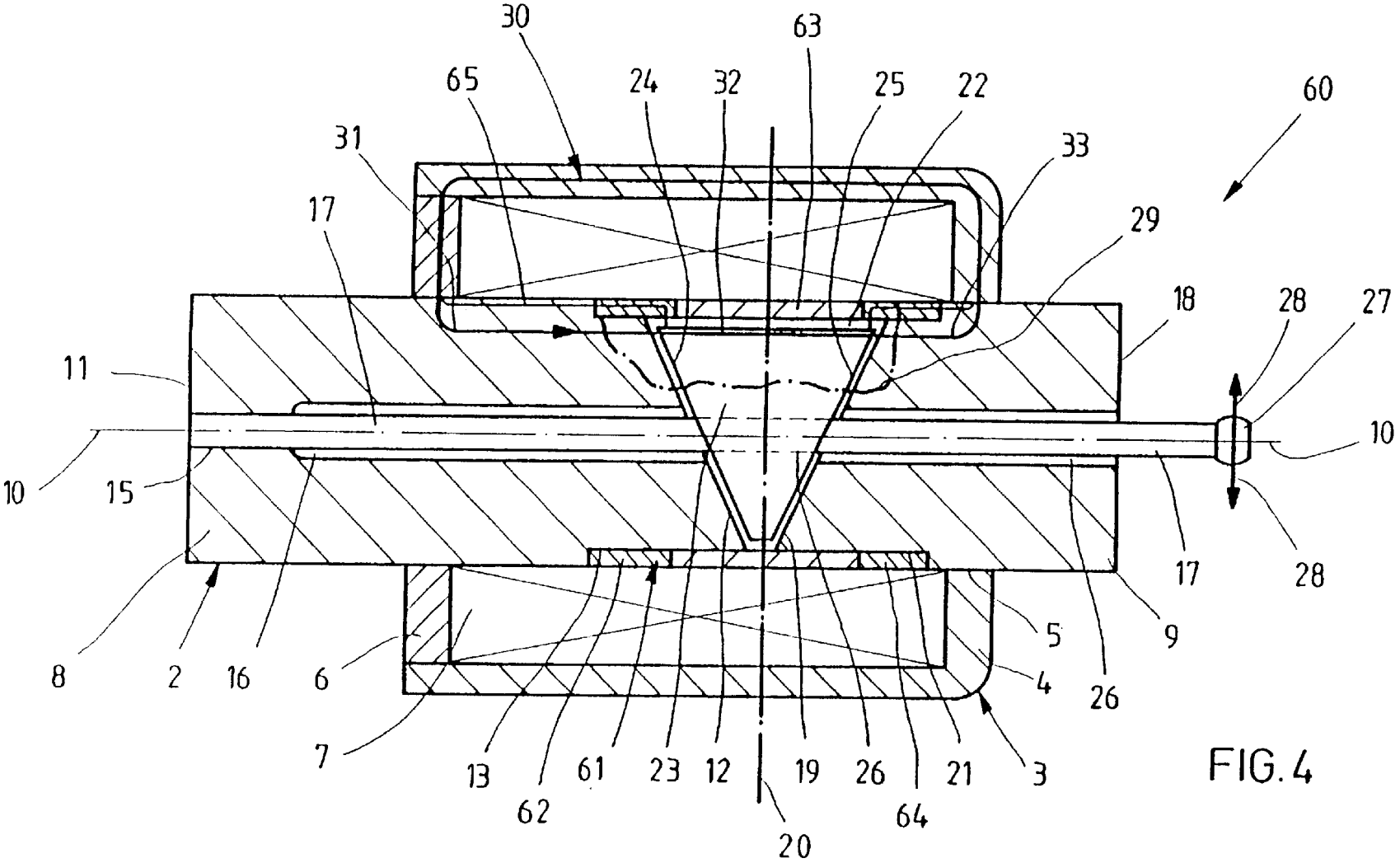
FIG. 4 shows a cross-section through a further pole according to the invention.

FIG. 4 shows a further pole 60 according to the invention, which corresponds in its essential parts to the pole 1 according to the invention in FIG. 1. Identical parts are therefore provided with the same reference numerals.

The pole 60 has a pressure tube 61 which is essentially in the shape of a hollow cylinder. The pressure tube 61 is divided here into a first pressure tube section 62 made of magnetizable material, into a second pressure tube section 63 made of antimagnetic material and into a third pressure tube section 64 made of magnetizable material.

The first pressure tube section 62 and the third pressure tube section 64 are of such a length that the broader side of the magnet armature 23 is just still located under the first pressure tube section 62 or under the third pressure tube section 64.

Figure 5:
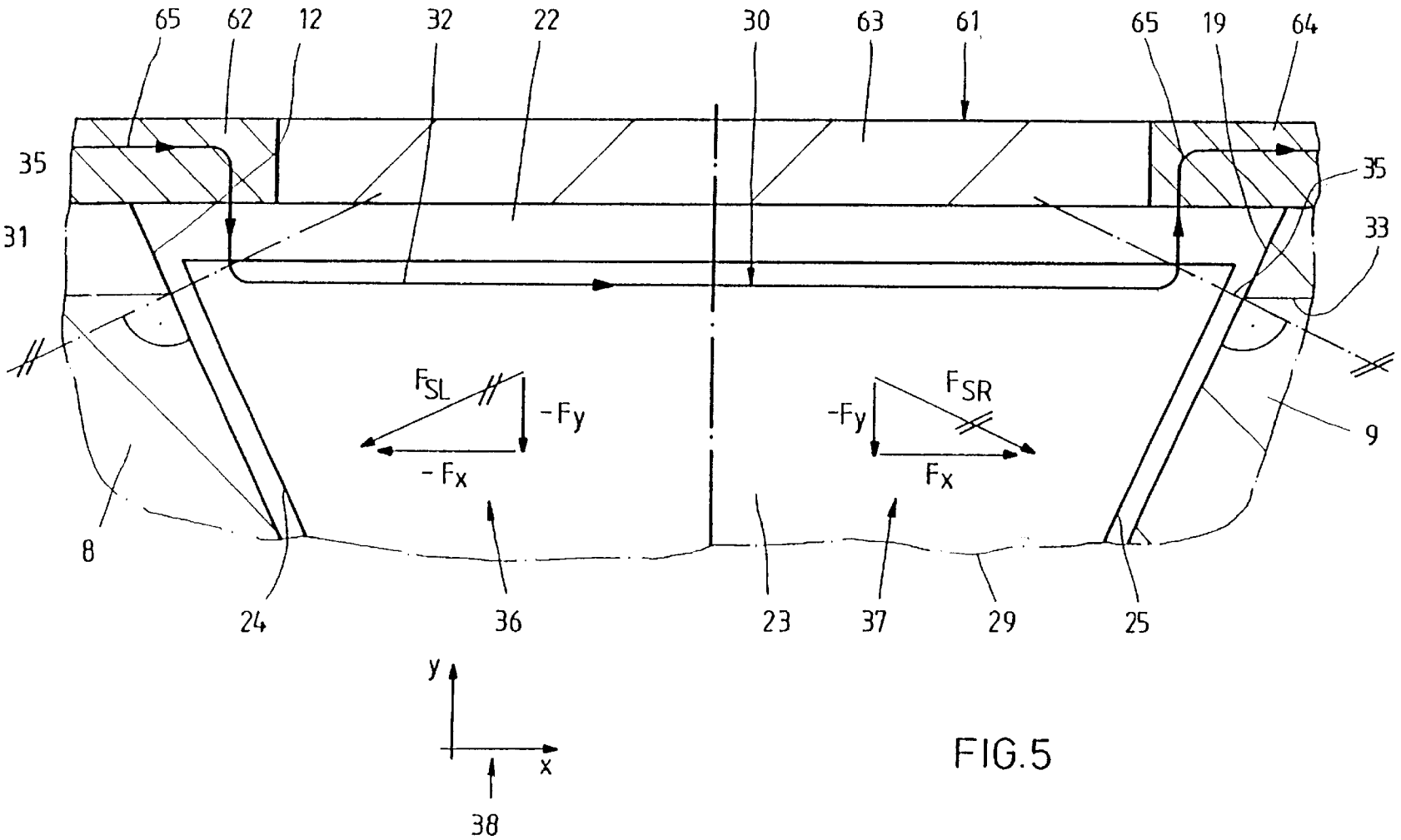
FIG. 5 shows an enlarged detail of the illustration of the pole in FIG. 4.

In FIG. 4, in addition to the field line 30, a partial field line 65 is shown which starts from the first core section 8 and extends into the first pressure tube section 62, and from there enters the outer surface of the magnet armature 23. In the interior of the magnet armature 23, the partial field line 65 extends parallel to the second field line section 32 and past the second pressure tube section 63 until it emerges from the magnet armature 23 in the region of the third pressure tube section 64. There, the partial field line 65 enters the third pressure tube section 64 from where it runs into the second core section 9 and closes the magnetic circuit again via the coil housing 4 and the annular washer 6. The course of the partial field line 65 is illustrated in more detail in FIG. 5.

Figure 6:
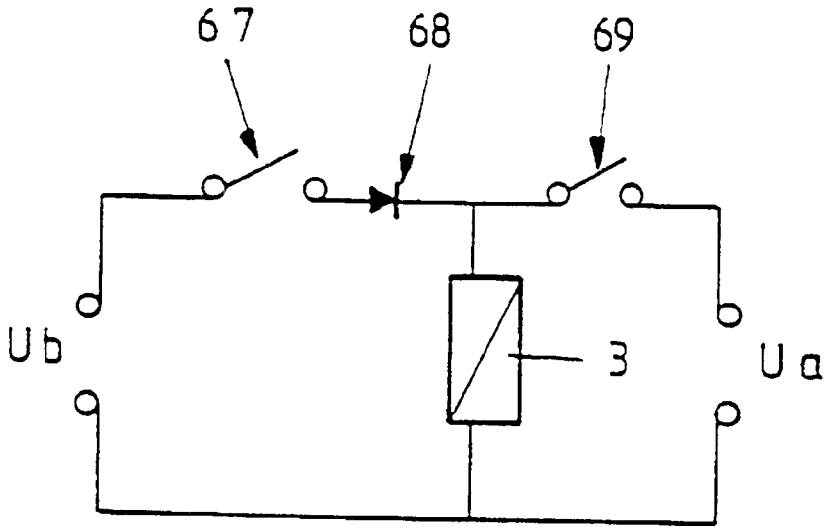
FIG. 6 shows a circuit diagram for the operation of the pole in FIG. 4.

FIG. 6 shows an electrical circuit 66 for operating the pole 60 from FIG. 4. Only the coil 3 of the pole 60 is shown in FIG. 6. A voltage Ub can be applied to the coil 3 via a first switch 67. A diode 68 is also arranged in the circuit which is closed by the first switch 67.

The electrical circuit 66 also has a second switch 68 via which a second operating voltage Ua can be applied to the terminals of the coil 3. Here, the second operating voltage Ua is higher than the first operating voltage Ub.

During operation, the magnet pole 60 which is wired according to FIG. 6 behaves as follows. In a state before switching occurs, the first switch 67 is in the closed state. In this state, there is saturation in the region of the air gaps between the first pressure tube section 62 and the magnet armature 23, and between the third pressure tube section 64 and the magnet armature 23, respectively. In order to switch the pole 60, the second switch 69 is activated so that the coil 3 is also supplied by the operating voltage Ua. In this state, the force generated in the working gap between the first core section 8, the magnet armature 23 and the second core section 9 is of such a magnitude that the magnet armature 23 is pulled downward in the view shown in FIG. 4. As a result, in each case the air gap between the magnet armature 23 and the first pressure tube section 62 or the second pressure tube section 63 is increased so that the greater part of the flux of the magnetic field is displaced into the part of the working air gap. As a result, there is a rapid switching process of the pole 60 according to the invention.

Figure 7:
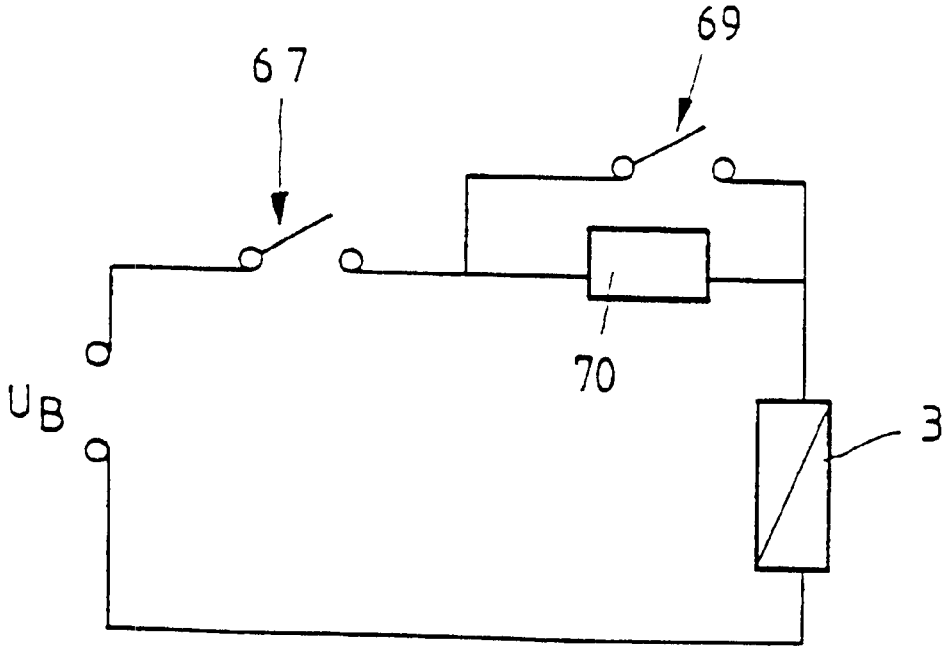
FIG. 7 shows a further circuit diagram for the operation of the pole in FIG. 4.

FIG. 7 shows a further schematic circuit diagram relating to the operation of the pole 60, according to the invention. According to FIG. 7, a single voltage source Ub is sufficient for this, it being possible to apply to the coil 3 a voltage, reduced by a series resistor 70, via the first switch 67 and the series resistor 70. The second switch 69 is connected in parallel with the series resistor 70, the second switch 69 bypassing the series resistor 70 when activation occurs. This ensures that the coil 3 can have a total of three different operating voltages applied to it depending on the position of the first switch 67 and of the second switch 69.

Figure 8:
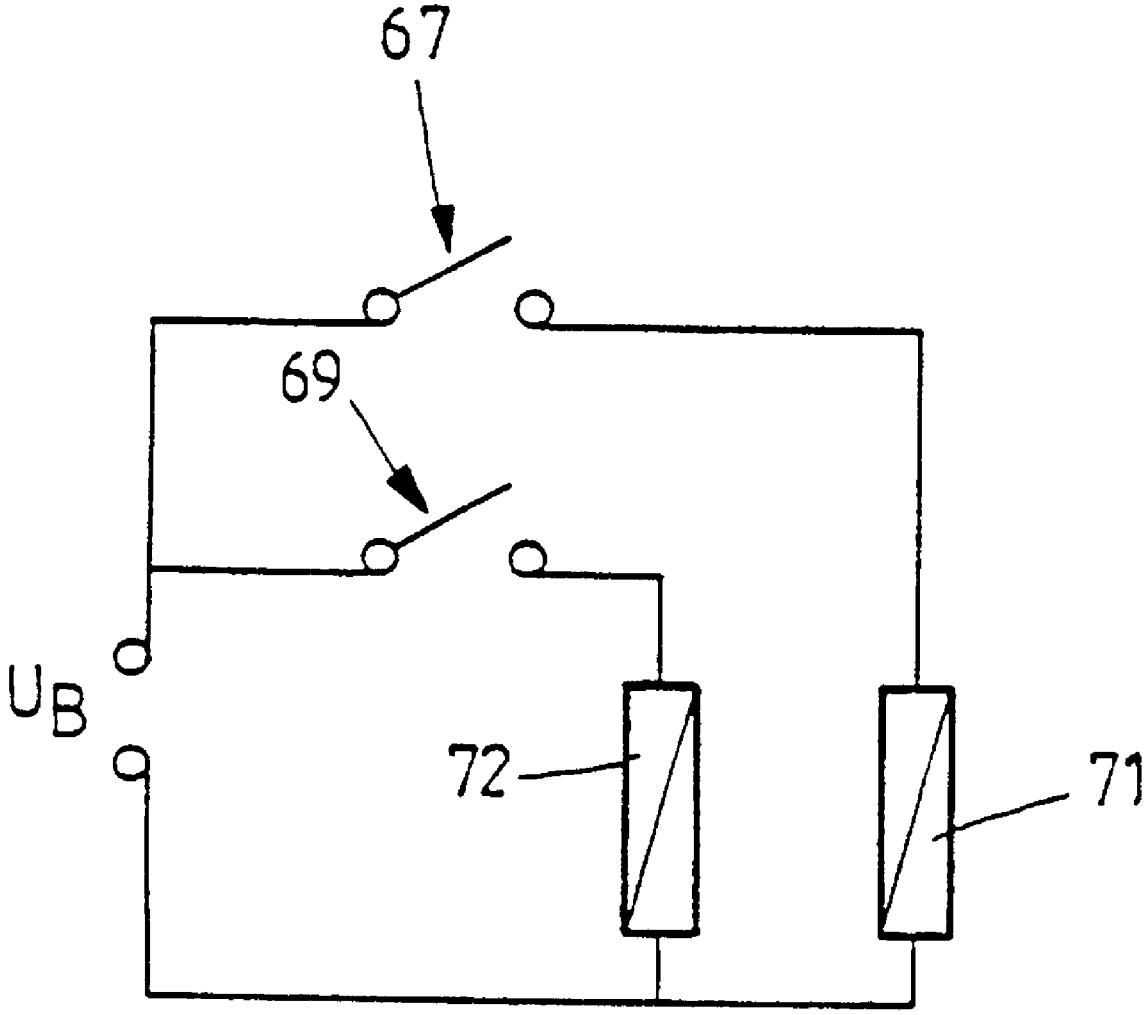
FIG. 8 shows a circuit diagram for the operation of a further pole according to the invention.

FIG. 8 shows a circuit diagram relating to the operation of a pole (not shown in this view) which has a first coil 71 and a second coil 72. Here, the first coil 71 is used for pole premagnetization according to the invention, while the second coil 72 is used to connect through the pole. The operating voltage Ub is applied to the first coil 71 via the first switch 67. The operating voltage Ub is applied to the second coil 72 by means of the second switch 69.

Figure 9:
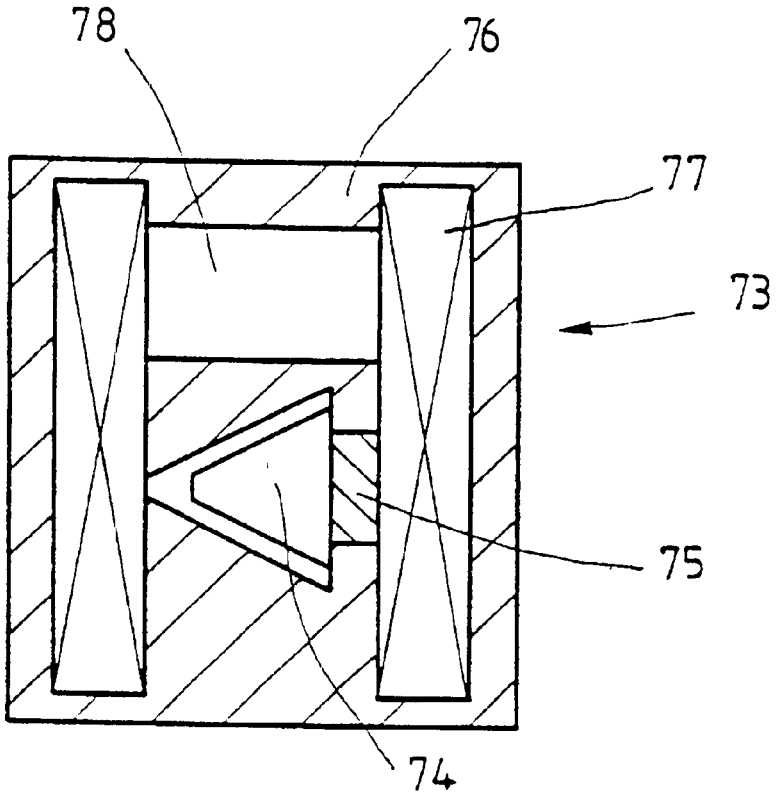
FIG. 9 shows a schematic view of a further pole according to the invention.
Figure 10:
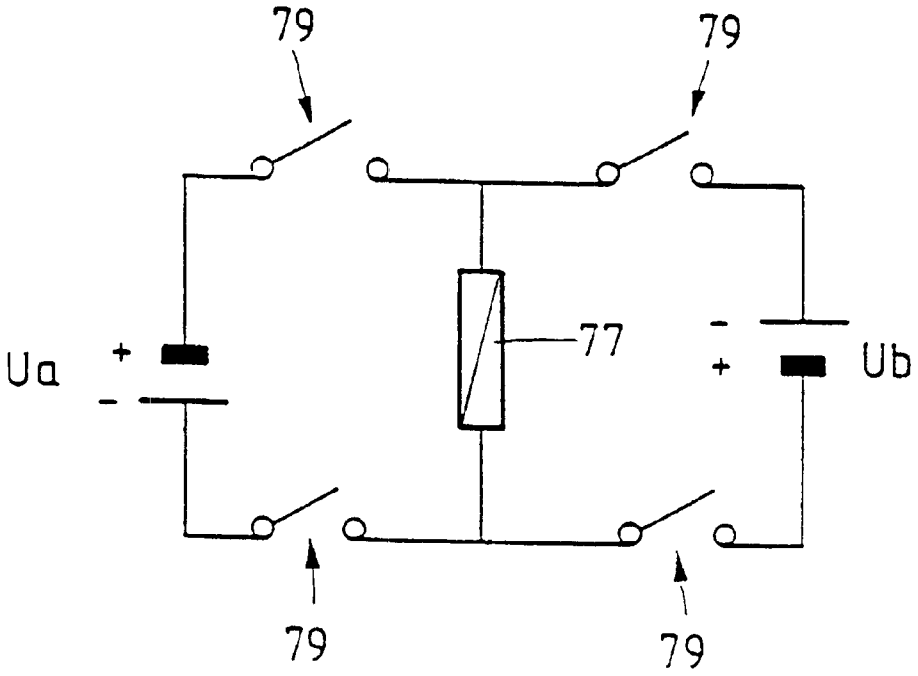
FIG. 10 shows a circuit diagram for the operation of the pole in FIG. 9.

FIGS. 9 and 10 show a further pole 73 according to the invention, of which this view shows only a magnet armature 74, a pressure tube 75, a coil housing 76, a coil 77 and a permanent magnet 78 which is arranged in the region of the coil 77.

When the pole 73 is operating, the magnet armature 74 is premagnetized by the permanent magnet 78. In order to activate the pole 73, a first operating voltage Ua and a second operating voltage Ub can be applied to the coil 77, which can be seen particularly well in FIG. 9. The voltages Ua and Ub each have a reversed polarity so that the polarity of the coil 77 can be reversed using switches 79 in order to switch the permanent magnet 78 on or off.

I claim:

1. An electromagnet, for actuating a hydraulic solenoid valve (50), having a coil core (8, 9) of an electrical coil in a region of the coil core, which coil core is made of magnetizable material and extends along a longitudinal axis (10), the electromagnet also having the following features:

an armature tappet (17) which extends essentially parallel to said longitudinal axis (10) is provided in a tappet opening (16) which extends in the interior of the coil core (8, 9)

at least one magnet armature (23) is provided on the armature tappet (17), said magnet armature (23) having at least one armature side face (24, 25) which cuts through the longitudinal axis (10) at an angle other than 90°, and the coil core (8, 9) is interrupted in a region of the magnet armature (23).

2. The electromagnet as claimed in claim 1, wherein the magnet armature has two armature side faces (24, 25) which are cut from the longitudinal axis (10) at an angle other than 90°.

3. The electromagnet as claimed in claim 2, wherein the two armature side faces (24, 25) are constructed so as to be symmetrical with respect to a plane (20) which extends perpendicularly to the longitudinal axis (10).

4. The electromagnet as claimed in claim 1, wherein the coil core (8, 9) has at least one core side face (12, 19) which cuts through longitudinal axis (10) at an angle other than 90°.

5. The electromagnet as claimed in claim 4, wherein the coil core (8, 9) has two core side faces (12, 19) which are cut through the longitudinal axis (10) at an angle other than 90°.

6. The electromagnet as claimed in claim 5, wherein the two core side faces (12, 19) are constructed so as to be symmetrical with respect to a plane (20) which extends perpendicularly to the longitudinal axis (10).

7. The electromagnet as claimed in claim 4, wherein in each case one armature side face (24, 25) extends essentially parallel to, in each case, one core side face (12, 19).

8. The electromagnet as claimed in claim 1, wherein a connecting region (14) which has antimagnetic material is provided in the interrupted region of the coil core (8, 9).

9. The electromagnet as claimed in claim 8, wherein a connecting region which has magnetizable material (62, 64) is provided in the interrupted region of the coil core (8, 9).

10. The electromagnet as claimed in claim 8, wherein the connecting region (14) has a tubular shape and connects interrupted sections of the coil core to one another.

11. The electromagnet as claimed in claim 1, wherein a first end of the armature tappet (17) is permanently connected to a first end (11) of the coil core (8, 9).

12. The electromagnet as claimed in claim 11, wherein a second end of the armature tappet (17) projects beyond a second end (18) of the coil core (8, 9).

13. The electromagnet as claimed in claim 1, wherein two electrical coils which are arranged coaxially with respect to one another are provided.

14. The electromagnet as claimed in claim 1, wherein at least three different operating voltages are applicable to the electrical coil (3) or electrical coils.

15. The electromagnet as claimed in 1, further comprising a permanent magnet (78) arranged in the region of the coil core.

* * * * *